US005922102A

United States Patent [19]

Fink

[11] Patent Number: 5,922,102

[45] Date of Patent: Jul. 13, 1999

[54] PROCEDURE FOR MANUFACTURING ZINC PARTICLES

[75] Inventor: Klaus Fink, Northfield, Ohio

[73] Assignee: Moen Incorporated, North Olmsted, Ohio

[21] Appl. No.: 08/990,391

[22] Filed: Dec. 15, 1997

[51] Int. Cl.[6] ..... B22F 9/08

[52] U.S. Cl. ..... 75/334; 75/340; 75/356; 75/360; 164/46

[58] Field of Search ..... 75/334, 340, 356, 75/357, 360; 164/46, 485

[56] References Cited

U.S. PATENT DOCUMENTS 4,069,045 1/1978 Lundgren ..... 75/356
4,915,729 4/1990 Boswell et al. ..... 75/356

FOREIGN PATENT DOCUMENTS 63-103007 5/1988 Japan ..... 75/334
2-228432 9/1990 Japan ..... 75/663

*Primary Examiner*—George Wyszomierski
*Attorney, Agent, or Firm*—Dorn, McEachran, Jambor & Keating

[57] ABSTRACT

A procedure for making zinc particles of a size, shape and composition such that the particles can be subsequently used in a process for manufacturing zinc parts from such particles in either molten or powder form includes the initial step of heating zinc to a temperature at least as high as 720° C. The molten zinc is passed through a screen having small openings, on the order of about ¼"×¼" into a cooling region formed by a movable surface which is at a temperature of on the order of about −200° C. The zinc forms small particles as it passes through the openings in the screen and essentially instantaneously solidifies as it contacts the movable surface. Thereafter, the solidified zinc particles are subjected to a grinding process to reduce their size to a powder having a surface area in the range of 2 $mm^2$ to 20 $mm^2$.

5 Claims, 1 Drawing Sheet

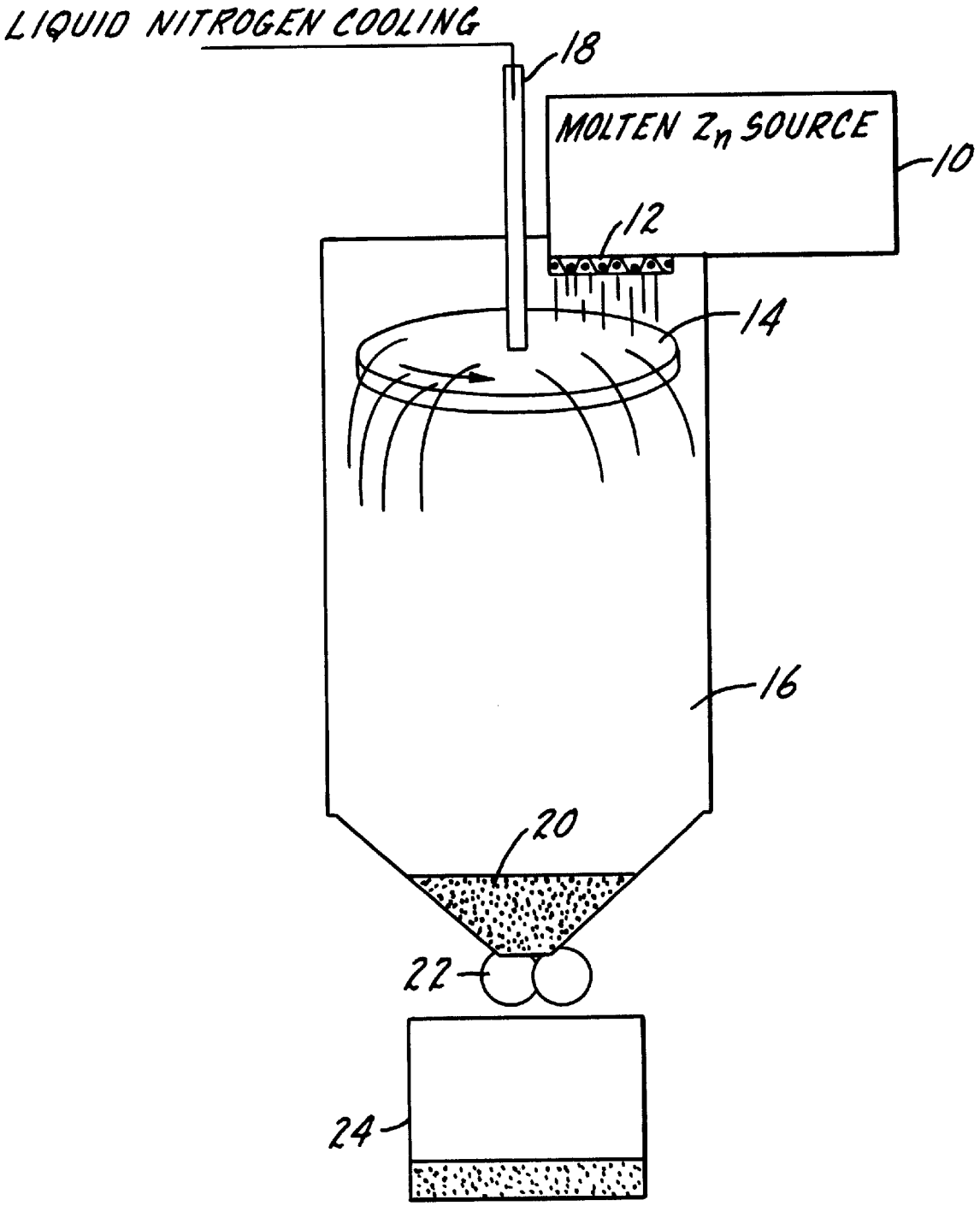
LIQUID NITROGEN COOLING
18
MOLTEN Zn SOURCE
10
12
14
16
20
22
24

PROCEDURE FOR MANUFACTURING ZINC PARTICLES

THE FIELD OF THE INVENTION

The present invention relates to a process for the manufacture of zinc particles which may be used in a thixomolding process for the manufacture of zinc parts or products.

The procedure for making the zinc particles consists of first heating zinc to a temperature at least as high as 720° C. such that the zinc is in molten form. The molten zinc is then passed through a screen or sieve having a plurality of small openings on the order of about ¼"×¼" or smaller. The zinc passing through the openings forms small particles which drop into a cooling region which is formed by a rotating copper disk. The disk is cooled to a temperature of about −200° C. by liquid nitrogen. The zinc particles essentially instantaneously solidify as they contact the rotating copper disk and the particles are then thrown off the disk into a chamber. In the chamber the zinc particles will be subject to an inert gas which may be chosen from the group consisting of nitrogen, argon and helium. The particles which will accumulate in the bottom of the chamber are then fed through a grinder which shreds the particles into irregular shapes having a surface area in the range of 2 $mm^2$ to 20 $mm^2$.

SUMMARY OF THE INVENTION

The present invention relates to a process for making zinc in particle or powder form without having surface contamination such as oxide films.

A primary purpose of the invention is a process for making zinc particles or powder in which the zinc is first heated to a temperature above its melting point, passed through a screen onto a cooling disk where the particles are instantaneously cooled after which the particles are ground to a desired size and shape.

Another purpose of the invention is to provide a reliable, simple and cost efficient method of manufacturing zinc particles of a desired size, shape and composition.

Other purposes will appear in the ensuing specification, drawings and claims.

BRIEF DESCRIPTION OF THE DRAWING

The invention is shown in the drawing which illustrates in diagrammatic form the process for forming zinc particles from molten zinc.

DESCRIPTION OF THE PREFERRED EMBODIMENT

The current method of manufacturing zinc particles or powder for use in a thixomolding process has been shown to be inadequate because thick oxide films form on the particles. The current process uses molten zinc at a temperature over 720° C. with the—molten zinc being passed through a sieve or screen into a water bath where the solidification process occurs. The thick oxide film that forms on the particles does not transfer heat well during a thixomolding process and therefore the material does not melt correctly and does not flow well when moved by a rotating screw in the injection molding machine. In thixomolding it is customary to use zinc in powder form. If the zinc does not melt correctly nor move correctly at the end of the injection screw, clearly the resulting parts will be inadequate and faulty. The present invention provides a process of making zinc particles for use in a thixomolding process which provides particles of a desired size, shape and composition.

As illustrated in the drawing, a molten zinc source is shown at 10 and the zinc will be heated to a temperature over 720° C., the melting point of zinc. The zinc within the source 10 will be passed through a sieve or screen 12 which may have openings of on the order of about ¼"×¼". The particles that pass through the sieve 12 will drop onto a rotating copper disk 14 which is positioned within a chamber 16. The disk 14 is cooled by liquid nitrogen through a tube 18 with the nitrogen maintaining the copper disk 14 at a temperature of approximately −200° C. The particles will be essentially instantaneously solidified as they contact the disk 14.

The disk 14 rotates and accordingly the solidified particles will be thrown off of the disk into the chamber 16. In the alternative, a scraper bar may be used to ensure that the particles are removed from the disk and fall into the chamber 16.

The chamber 16 may be flooded with an inert gas chosen from the group of nitrogen, argon and helium. Since liquid nitrogen is used for cooling the disk 14, it may be preferred that nitrogen fill the chamber 16.

The particles resulting from the solidification process will be deposited at the bottom of chamber 16 as indicated at 20. The particles so accumulated will pass through a shredder or grinder diagrammatically illustrated at 22 and then will be dropped down to a shipping bin 24.

The shredder 22 will reduce the size and shape of the particles so that they are irregular in configuration and have a surface area in the range of 2 $mm^2$ to 20 $mm^2$. This is only illustrative as one size and shape which is found to be satisfactory for a thixomolding process and the invention should not be limited thereto. What is important is to provide zinc particles, pure in composition, and of a size and shape which can be subsequently used in a thixomolding process.

Whereas the preferred form of the invention has been shown and described herein, it should be realized that there may be many modifications, substitutions and alterations thereto.

The embodiments of the invention in which an exclusive property or privilege is claimed are defined as follows:

1. A procedure for making zinc particles of a size, shape and composition such that the particles are useful in a process for manufacturing zinc parts using such zinc particles, said procedure including the steps of:

heating zinc to a temperature at least as high as 720° C. to form molten zinc;

passing said molten zinc through a plurality of small openings onto a cooling region formed by a movable surface and maintained at a temperature of about −200° C., the zinc forming small particles as it passes through the openings and solidified essentially instantaneously solidified particles as it contacts the movable surface;

thereafter subjecting said solidified particles to a grinding process to reduce the solidified particles to a size having a surface area in the range of 2$mm^2$ to 20$mm^2$.

2. The procedure of claim 1 comprising passing the molten zinc through openings having a size of approximately ¼"×¼".

3. The procedure of claim 1 wherein said movable surface is rotatable, is formed of copper and is cooled with liquid nitrogen.

4. The procedure of claim 1 further comprising throwing the particles from said movable surface, by the movement thereof, into a chamber flooded with an inert gas.

5. The procedure of claim 4 wherein said inert gas is chosen from the group consisting of nitrogen, argon and helium.

* * * * *